US006247505B1

(12) United States Patent
Wörman

(10) Patent No.: US 6,247,505 B1
(45) Date of Patent: Jun. 19, 2001

(54) TERRY FABRIC OR VELOUR FABRIC AND METHOD FOR THE PRODUCTION THEREOF

(75) Inventor: Horst Wörman, Gütersloh (DE)

(73) Assignee: Frottierweberei Vossen GmbH (DE)

( * ) Notice: Subject to any disclaimer, the term of this patent is extended or adjusted under 35 U.S.C. 154(b) by 0 days.

(21) Appl. No.: 09/582,354

(22) PCT Filed: Oct. 23, 1998

(86) PCT No.: PCT/EP98/06740

§ 371 Date: Jun. 23, 2000

§ 102(e) Date: Jun. 23, 2000

(87) PCT Pub. No.: WO00/24953

PCT Pub. Date: May 4, 2000

(51) Int. Cl.[7] ..... D03D 27/08
(52) U.S. Cl. ..... 139/396; 139/37
(58) Field of Search ..... 66/169 R, 170, 66/190, 191, 194; 139/391, 396, 39, 37, 35

(56) References Cited

U.S. PATENT DOCUMENTS 3,721,272 * 3/1973 Hager ..... 139/396
5,336,543 * 8/1994 Pyle ..... 139/396
5,557,950 9/1996 Richards et al. .
5,667,865 * 9/1997 Jackson et al. ..... 428/92

FOREIGN PATENT DOCUMENTS 42 00 278 8/1993 (DE) .
2 221 948 7/1974 (FR) .
2 746 818 10/1997 (FR) .

* cited by examiner

*Primary Examiner*—Danny Worrell
(74) *Attorney, Agent, or Firm*—Cantor Colburn LLP

(57) ABSTRACT

This invention is aimed at providing a terry-cloth or velours fabric, and a predictably economic process for its production, whereby it is possible to optimally adapt the fabric to different purposes. The proposed approach is a process for producing a terry or velours fabric consisting of a carrier web and, anchored in the carrier web, a nap in the form of open or dosed loops, of a warp of cotton loops the cut or uncut loops of which extend from one surface of the carrier web, and of a warp of microfiber loops the cut or uncut loops of which protrude from the opposite surface of the carrier web, the said warp of cotton loops and, respectively, the warp of microfiber loops being interlaced on the respective surface from which they protrude at the time the carrier web is produced.

7 Claims, 1 Drawing Sheet

TERRY FABRIC OR VELOUR FABRIC AND METHOD FOR THE PRODUCTION THEREOF

TECHNICAL FIELD

This invention relates to a terry-cloth or velours fabric and to a process for producing said fabric; with a carrier web and, anchored in said web, an open- or closed-loop nap; with a cotton-loop warp the cut or uncut loops of which protrude from one surface of the carrier web; and with a microfiber-loop warp the cut or uncut loops of which protrude from the opposite surface of the carrier web.

BACKGROUND OF THE INVENTION

A generically similar terry or velours fabric has been described in DE 42 00 278 C1. Carrier webs are produced in essentially conventional fashion by weaving, interlacing or knitting. In the case of terry or velours fabrics, the woven or knit substrate is provided with a pile of open or closed loops which give the cloth concerned its characteristic properties. The loops of a cotton fabric contribute to the absorptivity of the material that is desired in towels or bathrobes. The loops can also serve as spacers between the basic web and the body of the user, for instance in the case of bedding which makes it feel pleasantly cool.

In order to significantly enhance the absorptivity (water absorption) of a terry or velours fabric, the method applied in prior art has involved the addition of microfibers which form an open or closed-loop nap on the surface opposite the surface with the cut or uncut cotton-loop pile.

Microfiber yarns in the form of multifilar, mostly textured synthetic fibers consisting for instance of polyamide have been used for flat fabrics in making wind-resistant and water-repellent clothing. In terms of moisture transfer, a combination of cotton terry and microfibers has proved particularly advantageous. The open- or closed-loop microfibers readily absorb the moisture and transfer it to the basic terry or velours material, making this type of fabric especially suitable for towels, bathrobes, leisure clothing etc.

In conventional terry cloth, the loops are always of the same height due to the production process employed, i.e. the proportion of the various materials incorporated on the nap side is about 50/50. When a terry fabric is produced on a loom, a change in texture is obtainable only by varying the weft, i.e. the course grouping per centimeter. Multiple variations are also possible by changing the thickness of the yarn in the weft and in the basic warp.

In all cases, however, the loops of different materials on either side of the carrier web will always be identical in height.

It follows that the terry or velours fabrics cannot be optimized for different purposes.

SUMMARY OF THE INVENTION

Given the current state of the art, this invention is aimed at providing a terry-cloth or velours fabric, and an appropriate, predictably economical production process, whereby it is possible to optimize the fabric for different purposes.

According to the methodology-related technical solution proposed for improving the generic process, the cotton-loop warp and the microfibre-loop warp are individually interlaced into the respective surface at the time the carrier web is produced.

The method according to this invention, employing a novel production device including at least one additional interlacing bar, results in an altogether new type of terry or velours fabric, with loop sequences on both sides the height of which can be controlled at random. This permits optimization of the terry or velours fabric for any desired purpose by employing the process according to this invention.

If, for example, increased moisture absorption is to be attained, it will be desirable to provide a higher microfiber pile on the upper or lower surface supporting the microfiber warp. The cotton-loop warp on the opposite surface can still be of any desired height, for instance short if a light-weight material is to be produced.

The terry or velours fabric produced by the process according to this invention is characterized by the fact that the cotton-loop warp and the microfiber-loop warp on the respective surface are stitched in at the time the carrier web is produced. The respective warp may differ in height, the loop picks are tied into the heddles. This offers the advantage of permitting control of the firmness of the fabric. Depending on the purpose intended, a more loosely or more tightly knit fabric can be produced. The loops can be cut to create a velours fabric without the risk of loops coming loose and falling out.

Preferably, a loop sequence from each surface, perhaps consisting of different materials, is broad-knit on the woven carrier web during the weaving cycle.

The invention presents an innovative process for producing a terry or velours fabric, the result being a novel type of terry or velours fabric. It is basically possible to substitute other yarns for the microfiber warp if that makes the terry cloth more suitable for the intended purpose.

BRIEF DESCRIPTION OF THE DRAWINGS

Additional advantages and features of the invention become evident in the following description with the aid of the diagram in which.

DETAILED DESCRIPTION OF THE PREFERRED EMBODIMENT

The drawings show a longitudinal section parallel to the warp, i.e. perpendicular to the plane of the weft of a terry cloth produced on a carrier web.

Figure 2:
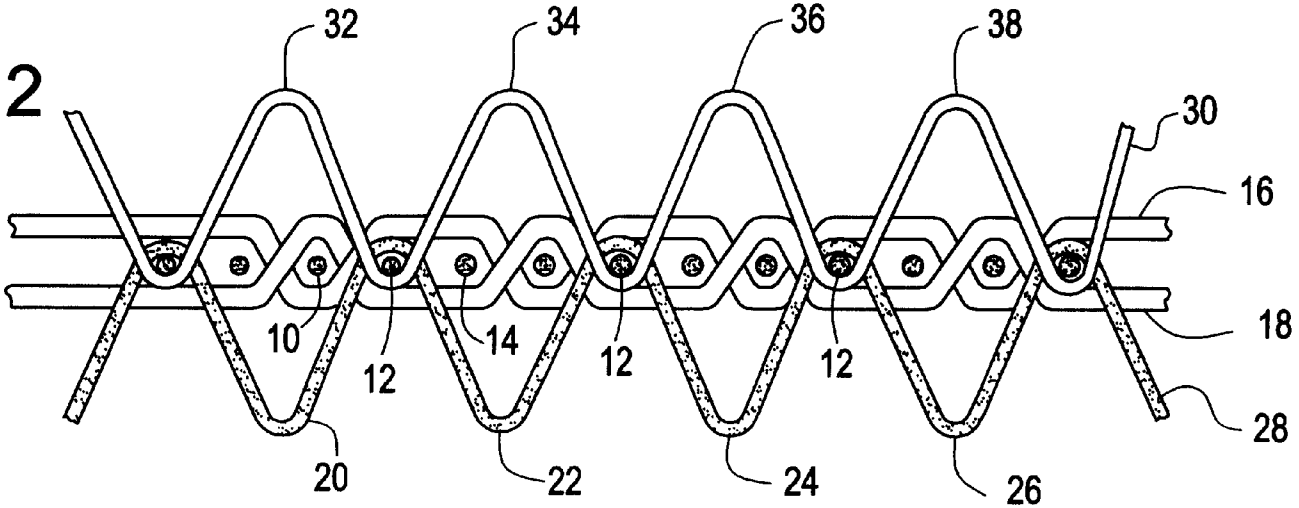
FIG. 2 is a longitudinal section through another form of woven material according to this invention.

In a similar, woven product shown in FIG. 2 in relation to their position in the web, three groups of picks 10, 12, 14, in consecutive order and then repeated, are provided. Picks which are positionally repeated in the terry cloth bear the same reference number. Also shown are two adjoining warp ends which, as is typical in weaving, alternate in individually wrapping around one or several picks. To form the cotton loops 20, 22, 24, 26, additional looped warp ends 28 are provided between the warp ends 16 and 18 and, in the example shown, extend around the picks 12 and out through the bottom surface of the web of material. Additional looped warp ends in the form of microfiber yarns 30 are provided; they too wrap around the picks 12 but form loops 32, 34, 36, 38 on the upper web surface and are thus located on the side opposite that of the cotton loops 20, 22, 24, 26. These microfiber loops far more quickly absorb moisture than do loops of cotton or other textile materials. Consequently, when processed into a towel or bathrobe, they readily absorb the moisture on the skin of the user and transfer it to the outside.

Figure 1:
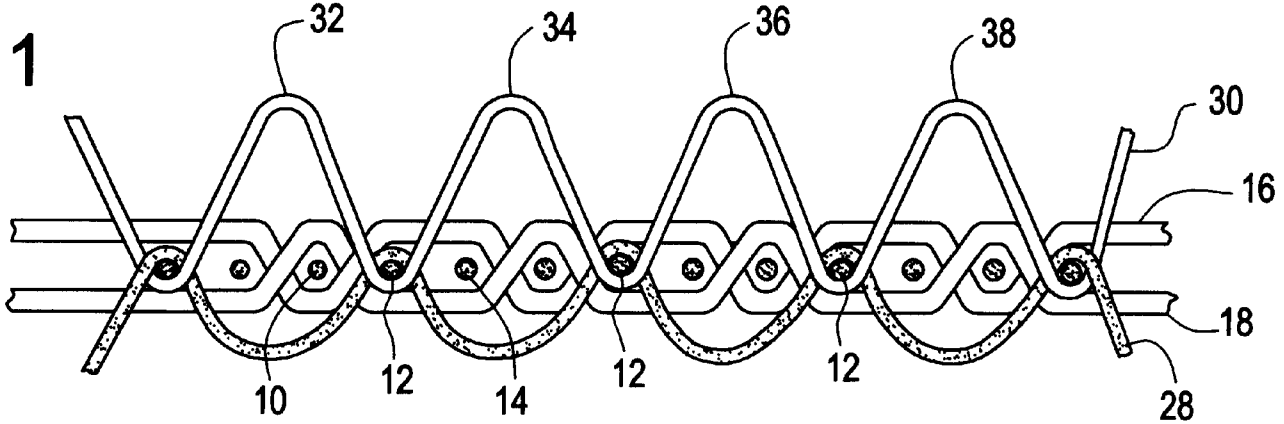
FIG. 1 is a longitudinal section through one form of woven material according to this invention.

For the enhanced absorptivity of a terry or velours fabric of this type, the cotton warp ends 28 and, respectively, the microfiber warp ends 30 are interlaced into the web from the exit side in the direction shown in FIG. 1. This makes it possible to have loops of a different height on either web surface. Accordingly, in the example per FIG. 1 the microfiber loops 32, 34, 36 and 38 are substantially higher than the cotton loops 20, 22, 24 and 26. In lieu of the cotton yarns and of the microfiber yarns discussed above, other suitable materials may be used. If the loops shown are cut or cropped, the result will be a velours fabric where, in the example per FIG. 1, it is impossible for the loops to separate from the web since the yarns are interlaced and tied to the picks. Indeed, it is possible to produce a fabric one surface of which is looped terry cloth while the other surface is velours.

The implementation example has been described for explanatory purposes only and is not limiting in nature.

What is claimed is:

1. A process for manufacturing a terry cloth or velour fabric comprising:

interweaving a plurality of warps around a plurality of picks to form a support strip such that adjoining warps crossly wrap around one or more picks;

interlacing cotton elements in said support strip such that cotton loops are formed emerging from a first surface of said support strip; and interlacing microfiber elements in said support strip such that microfiber loops are formed emerging from a second surface of said support strip;

wherein said first surface and said second surface are located opposite one another; and wherein said cotton elements and said microfiber elements are interlaced individually in said support strip dunning said interweaving of said support strip.

2. The process as in claim 1 wherein said interlacing cotton elements forms said cotton loops having a first size and said interlacing microfiber elements forms said microfiber loops having a second size wherein said first size is different than said second size.

3. A they cloth or velour fabric comprising:

a support strip including a plurality of warps and a plurality of picks, said warps crossly wrapped around one or more of said picks;

cotton elements interlaced in said support strip such that cotton loops extend from a first surface of said support strip; and microfiber elements interlaced in said support strip such that microfiber loops extend from a second surface of said support strip;

wherein said first surface and said second surface are located opposite one another; and wherein said cotton loops and said microfiber loops are anchored to said support strip; and wherein said cotton elements and said microfiber elements are individually interlaced into said support strip during formation of said support strip.

4. The fabric as in claim 3 wherein said cotton loops have a first size and said microfiber elements have a second size, said first size being different than said second size.

5. The fabric as in claim 3 wherein said cotton loops and/or said microfiber loops are tied to a stitch wail.

6. The fabric as in claim 3, wherein said cotton loop and/or said microfiber loops are tied to said picks.

7. The fabric as in claim 3, wherein said cotton loops and/or said microfiber loops are cut to form piles.

* * * * *